United States Patent [19]

Griffis

[11] Patent Number: 4,479,235

[45] Date of Patent: Oct. 23, 1984

[54] SWITCHING ARRANGEMENT FOR A STEREOPHONIC SOUND SYNTHESIZER

[75] Inventor: Patrick D. Griffis, Indianapolis, Ind.

[73] Assignee: RCA Corporation, New York, N.Y.

[21] Appl. No.: 352,180

[22] Filed: Feb. 25, 1982

[30] Foreign Application Priority Data

May 8, 1981 [GB] United Kingdom ..... 8114088

[51] Int. Cl.³ ..... H04R 5/00

[52] U.S. Cl. ..... 381/17; 358/144

[58] Field of Search ..... 381/17, 18; 358/143, 358/144, 198

[56] References Cited

U.S. PATENT DOCUMENTS

| | | | |
|---|---|---|---|
| 3,124,649 | 3/1964 | Pflager et al. | 179/1 |
| 3,662,113 | 5/1972 | Recklinghausen | 179/15 BT |
| 3,670,106 | 6/1972 | Orban | 179/1 G |
| 3,795,764 | 3/1974 | Altmann | 178/5.8 R |
| 3,924,072 | 12/1975 | Turner et al. | 179/1 GP |
| 4,167,651 | 9/1979 | Kempe | 179/1 J |
| 4,239,939 | 12/1980 | Griffis | 179/1 GP |
| 4,302,837 | 11/1981 | Tanaka et al. | 358/144 X |
| 4,399,329 | 8/1983 | Wharton | 358/144 X |

FOREIGN PATENT DOCUMENTS

| | | |
|---|---|---|
| 0015770 | 9/1980 | European Pat. Off. . |
| 2408141 | 9/1974 | Fed. Rep. of Germany . |
| 2640254 | 9/1976 | Fed. Rep. of Germany . |
| 1430210 | 3/1976 | United Kingdom . |
| 2053624 | 2/1981 | United Kingdom . |

*Primary Examiner*—R. J. Hickey

*Attorney, Agent, or Firm*—Paul J. Rasmussen; Peter M. Emanuel; Lawrence C. Edelman

[57] ABSTRACT

A system for synthesizing stereophonic signals from an audio information signal source is provided. The system includes a transfer function circuit for producing a modulated signal which varies in amplitude as a function of frequency in response to the audio signal, first and second amplifiers for providing amplified output signals, and a switch circuit for coupling selected ones of the audio signal and the modulated signal to the inputs of the first and second amplifiers. In a first position, the switch circuit causes the first and second amplifiers to operate in a matrix mode for matrixing the input signals to provide first and second synthesized stereophonic output signals, and in a second position, the switch circuit causes the amplifiers to operate in a non-matrix mode with respect to the input signals supplied thereto for providing an amplified audio output signal.

13 Claims, 3 Drawing Figures

SWITCHING ARRANGEMENT FOR A STEREOPHONIC SOUND SYNTHESIZER

Figure 1:
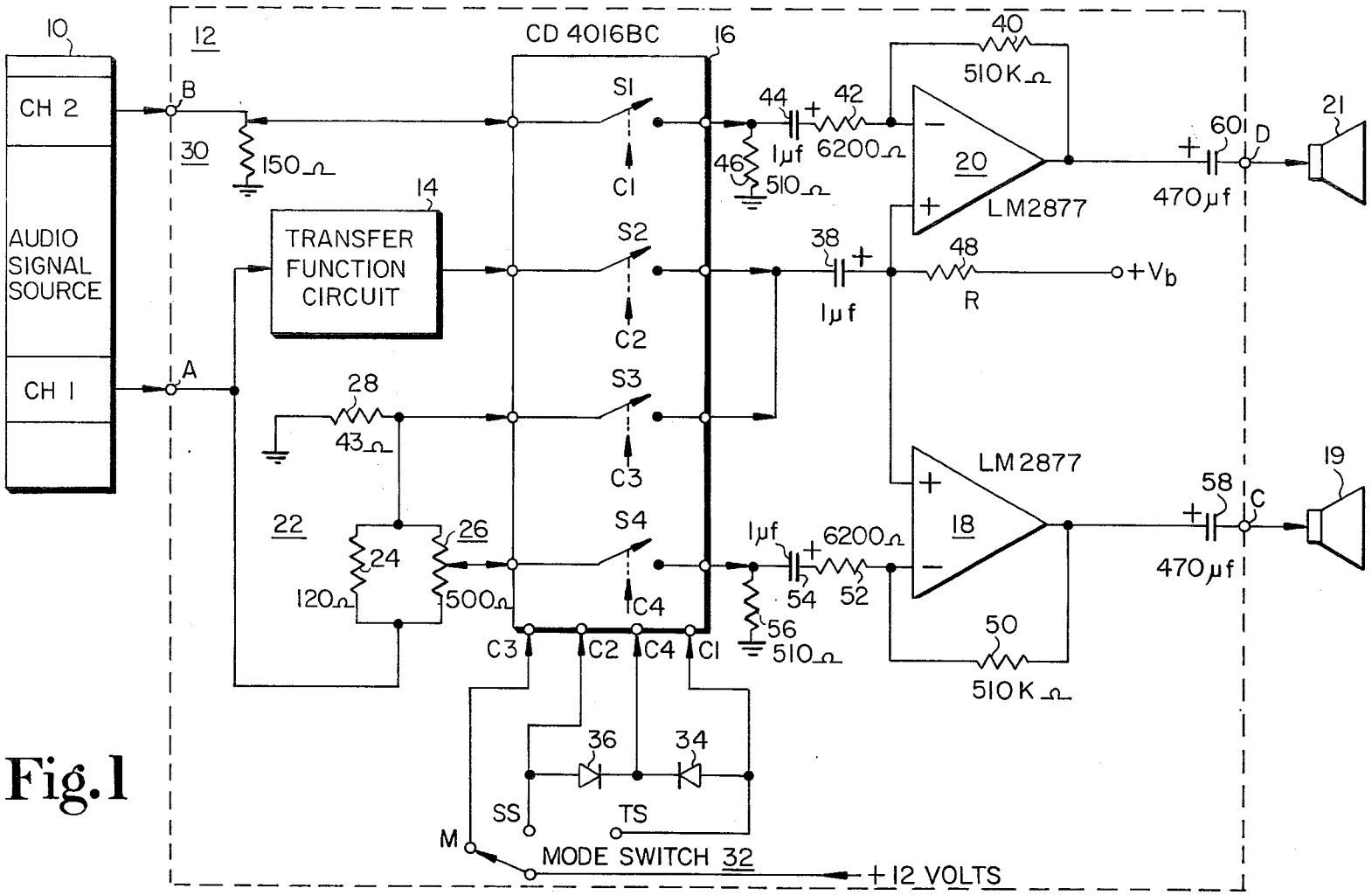

This invention relates to sound signal translation systems and more particularly to a stereophonic sound signal synthesizer system useful for selectively providing direct amplification of true stereophonic signals, synthesis of stereophonic signals or amplification of monophonic signals, in a television receiver, with a reduced amount of signal processing circuits.

Stereophonic sound synthesis in combination with a visual medium, such as a television receiver, is desirable since the depth and ambience created by the stereophonic effect provides the viewer with an enhanced sense of being part of the scene. One example of a stereophonic sound synthesizer included in a television receiver is described in U.S. Pat. No. 4,239,939 , issued Dec. 16, 1980 to P. D. Griffis. This patent describes a stereophonic sound synthesizer including two power amplifiers and a switch at the output of the amplifiers for selectively coupling either the amplified synthesized signals from the two power amplifiers, or amplified monophonic signals from an additional power amplifier, to sound reproducing loudspeakers.

The advent of video disc players and video cassette recorders with true stereophonic sound capability creates a need for television receivers which are capable of true stereophonic sound reproduction. Since television broadcast standards in the United States now provide for monophonic reception only, television receivers capable of true stereophonic sound reproduction would require external stereo inputs directly associated with the receiver's audio circuitry. The audio circuitry could include two driver amplifiers for supplying the true stereo signals to sound reproducing loudspeakers, in addition to two additional amplifiers for deriving synthesized stereophonic signals when desired. In some foreign countries, such as Germany and Japan, stereophonic television audio signal broadcasting already exists in addition to monophonic broadcasting. In the case of true stereophonic broadcasting, the receiver's stereo decoder derives the true stereo signals. Additional circuits are required to derive synthesized stereophonic signals when monophonic signals are received. The true stereophonic signals or the synthesized stereophonic signals are then applied to the loudspeakers via the two driver amplifiers.

It is herein recognized as desirable to provide a sound signal translation system including two amplifiers for driving sound reproducing loudspeakers, which amplifiers can operate as a matrix for deriving synthesized stereophonic signals or as two separate amplification channels, with respect to monophonic or true stereophonic input signals, respectively. Such an arrangement provides reduced circuit complexity and cost, and increased system reliability.

In accordance with the principles of the present invention, the above is achieved by a signal translation system for a source of audio information signals, comprising two audio amplifiers, a transfer function circuit for producing a modulated signal which varies in amplitude as a function of frequency in response to an audio information signal, and a switch. The switch includes plural inputs coupled independently of each other to receive respective ones of the audio signal and the modulated signal for selectively coupling these input signals to the audio amplifiers. In a first position of the switch, the audio amplifiers operate as a signal matrix with respect to the input signals for deriving first and second synthesized stereophonic signals. In a second position of the switch, the audio amplifiers operate as separate amplification channels with respect to the audio signal source for providing an amplified version of the audio signal.

In the drawing

Figure 2:
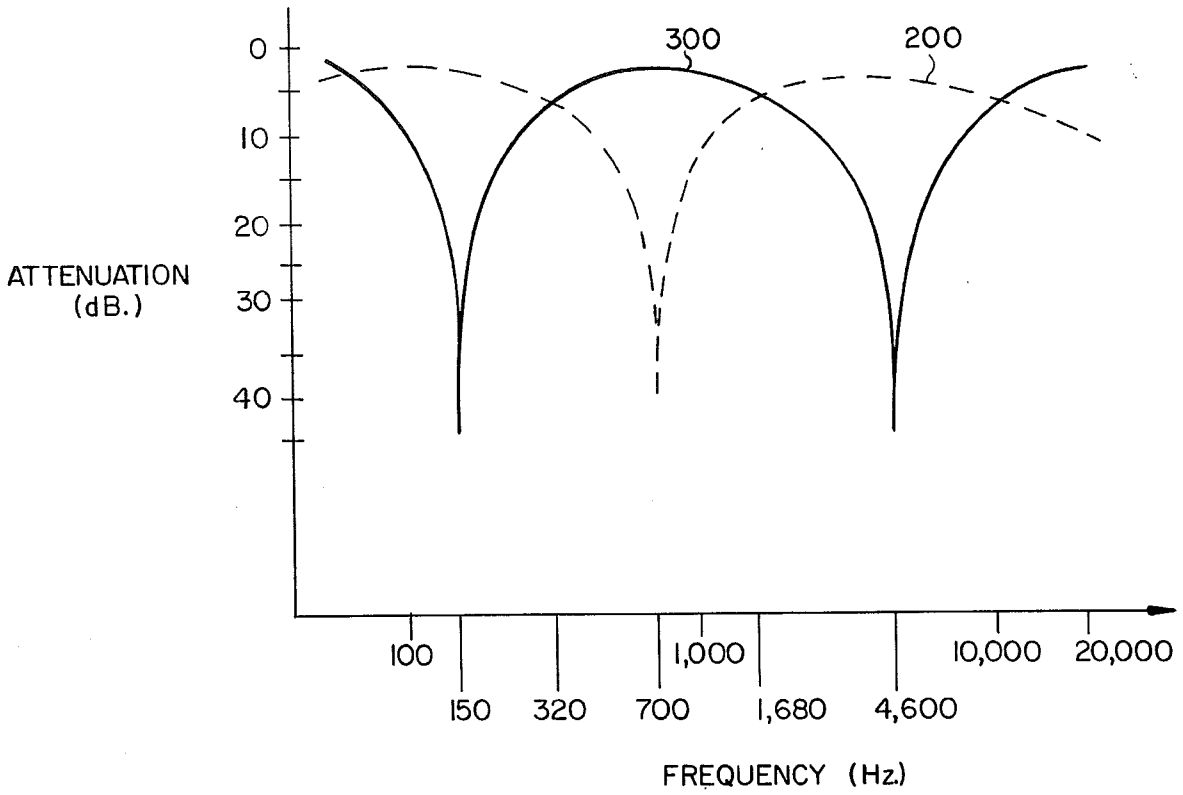
Figure 3:
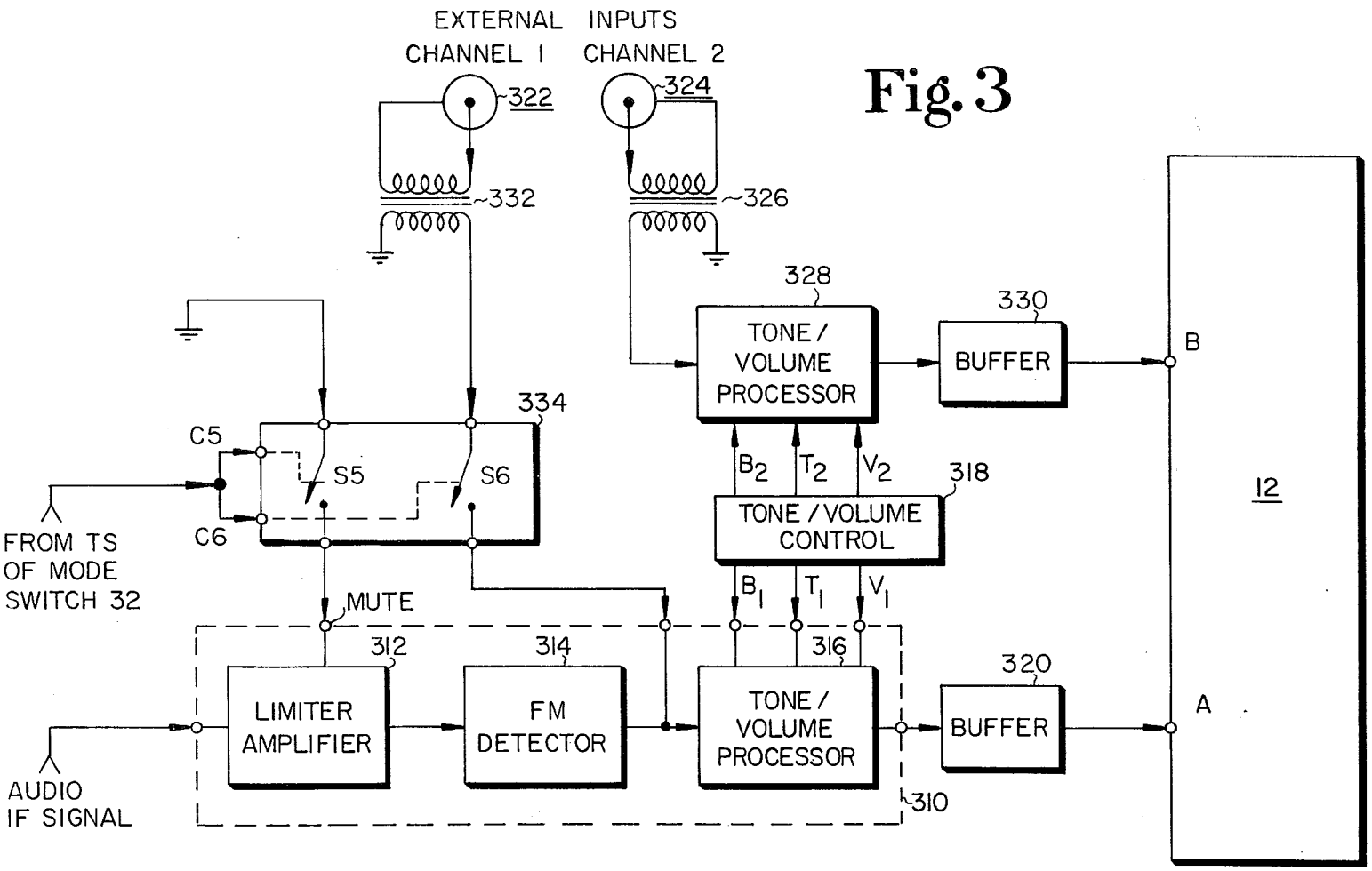

FIG. 1 illustrates, partically in block diagram form and partially in schematic diagram form, a stereophonic sound synthesizer constructed in accordance with the principles of the present invention;

FIG. 2 is a graphical illustration of the response curves of each channel of the stereo synthesizer of FIG. 1; and FIG. 3 illustrates, partially in block diagram form and partially in schematic diagram form, the stereophonic sound synthesizer of FIG. 1 incorporated into the audio signal processing portion of a television receiver for processing a television signal including a monophonic sound component and including plural external audio signal inputs.

Referring to FIG. 1, an audio information signal source 10, including low impedance channel 1 (CH1) and channel 2 (CH2) signal outputs, provides audio information signals to input terminals A and B of a stereophonic sound synthesizer 12. Stereophonic synthesizer 12 includes a transfer function circuit 14, a switch circuit 16 and dual power amplifiers 18 and 20 for providing amplified audio signals to output terminals C and D with a level sufficient to drive sound reproducing loudspeakers 19 and 21. Switch circuit 16 includes four independently controlled normally opened single-pole, single-throw switches $S_1$, $S_2$, $S_3$ and $S_4$ which may be included in a single integrated circuit, such as the CD4016BC Quad Bilateral Switch IC, available from RCA Solid State Division, Somerville, New Jersey. Power amplifiers 18 and 20 are each one-half of an LM2877 Dual Audio Power Differential Amplifier IC, available from National Semiconductor Corporation, Santa Clara, California.

The channel 1 audio signals applied to terminal A of stereo synthesizer 12 are coupled to a resistor voltage divider network 22 and to transfer function circuit 14. Divider network 22 includes a parallel arrangement of a resistor 24 and a potentiometer 26 coupled in series with a resistor 28, all connected between synthesizer input terminal A and ground. The wiper of potentiometer 26 supplies a variable amount of the channel 1 audio signal to the input of switch $S_4$. A fixed amount of the channel 1 audio signal is supplied to the input of switch $S_3$ from the junction of resistors 24 and 28 and potentiometer 26. Transfer function circuit 14 has an amplitude response which varies with frequency, and provides a modulated version of the channel 1 audio signal to the input of switch $S_2$. The frequency response of transfer function circuit 14 provides sharp attenuation at certain frequencies and relatively little attenuation at other frequencies, as will be described in greater detail later on with respect to the synthesis mode of operation. In a preferred embodiment, transfer function circuit 14 comprises a cascaded pair of twin-tee notch filters providing maximum attenuation at 150 Hertz and 4.8 kiloHertz, respectively, as described in detail in U.S. Pat. No. 4,239,939—Griffis. A potentiometer 30 is connected between synthesizer input terminal B and ground. The wiper of potentiometer 30 couples a variable portion of the channel 1 audio signal to switch $S_1$ of switch circuit 16.

A user operated mode switch 32 is operable to selectively apply +12 volts DC to the switch terminals labelled M (monophonic), SS (synthetic stereo) and TS (true stereo) for selectively closing switches $S_1$, $S_2$, $S_3$ and $S_4$. Switch control lines $C_1$, $C_2$, $C_3$ and $C_4$, respectively associated with switches $S_1$, $S_2$, $S_3$ *and* $S_4$, and directly connected to switch 32. Diodes 34 and 36, respectively coupled between control lines $C_1$ and $C_4$ and lines $C_2$ and $C_4$, apply +12 volts to control line $C_4$ when switch 32 is in either of positions SS or TS. Thus, when switch 32 is operated to apply +12 volts to terminal M, switch $S_3$ is closed; to terminal SS, switches $S_2$ and $S_4$ are closed; and to terminal TS, switches $S_1$ and $S_4$ are closed. The outputs of swithces $S_1$,$S_2$,$S_3$ and $S_4$ are coupled to the inputs of amplifiers 18 and 20. In this manner, mode switch 32 controls the coupling of the channel 1, channel 2 and modulated signal from transfer function circuit 14 to amplifiers 18 and 20, for causing synthesizer 12 to provide various modes of operation.

The various modes of operation for the arrangement of FIG. 1 are now described as follows.

Monophonic Mode

Monophonic operation results when mode switch 32 is turned to the M (monophonic) position, coupling +12 volts to control line $C_3$, causing switch $S_3$ to close (conduct). A voltage divided version of the channel 1 audio signal at synthesizer input terminal A is applied to a non-inverting input (+) of each of power amplifiers 18 and 20 via voltage divider 22, conductive switch $S_3$ and coupling capacitor 38. In the position of mode switch 32, switches $S_1$, $S_2$ and $S_4$ remain open (non-conductive).

Amplifier 20 includes a feedback resistor 40 coupled from its output to its inverting input (−), and the inverting input is coupled to ground via the series connection of resistor 42, coupling capacitor 44 and resistor 46. The impedance present by capacitor 44 and resistor 46 is small, at audio frequencies, compared to that of resisitor 42, thus, the gain of power amplifier 20 is substantially the ratio of the resistance value of resistor 40 to the value of resistor 42. In a similar manner, power amplifier 18 includes a feedback resistor 50 coupled from its output to its inverting input (−), and the inverting input is coupled to ground via the series connection of resistor 52, coupling capacitor 54 and resistor 56. The impedance presented by capacitor 54 and resistor 56 is small, at audio frequencies, compared to the value of resistor 52, thus, the gain of power amplifier 18 is substantially the ratio of the resistance value of resistor 50 to the value of resistor 52. A resistor 48 is coupled from a source of bias voltage ($+V_b$) to the non-inverting (+) inputs of amplifiers 18 and 20 for supplying bias currents thereto. Power amplifiers 18 and 20 exhibit similar signal gain. Thus, substantially identically amplified channel 1 audio signals are provided at the outputs of amplifiers 18 and 20 and are coupled to synthesizer output terminals C and D by capacitors 58 and 60, respectively.

True Stereo Mode

When mode switch 32 is turned to the TS (true stereo) position, +12 volts is coupled to control line $C_1$ to close (conduct) and, via diode 34, to control line $C_4$ causing switch $S_4$ to close (conduct). Diode 36, coupled between control lines $C_2$ and $C_4$, prevents +12 volts from being applied to control line $C_2$ when mode switch 32 is in the TS position. Switches $S_2$ and $S_3$ therefore remain open (non-conductive). A voltage divided version of the channel 1 audio signal at synthesizer input terminal A is coupled to the inverting input of amplifier 18 via the wiper of potentiometer 26, conductive switch $S_4$, capacitor 54 and resistor 52. Similarly, a voltage divided version of the channel 2 audio signal at synthesizer input terminal B is coupled to the inverting input of amplifier 20 via the wiper of potentiometer 30, conductive switch $S_1$, capacitor 44 and resistor 42. Amplified channel 1 and channel 2 audio information signals are provided at the outputs of amplifiers 18 and 20 and are coupled to synthesizer output terminals C and D.

The resistance values of resistors 24, 28 and potentiometer 26 are preferably small relative to the value for resistor 52 so that the gain of amplifier 18 is primarily determined by resistors 50 and 52. Similarly, the resistance value of potentiometer 30 is preferably small relative to the value for resistor 42 so that the gain of amplifier 20 is primarily determined by resistors 40 and 42. Potentiometer 30 is adjusted during set-up of the true stereo operating mode to match the signal gain provided between the pairs of input and output terminals of synthesizer 12 (i.e., between A and C and between B and D), after potentiometer 26 has been set to provide proper operation during the synthesis operating mode, which will next be described.

Synthetic Stereophonic Mode

When mode switch 32 is turned to the SS position, +12 volts is directly coupled to control line $C_2$, closing switch $S_2$, and via diode 36, to control line $C_4$, closing switch $S_4$. Diode 34 prevents +12 volts from being applied to control line $C_1$. Thus, switches $S_2$ and $S_4$ are conductive and switches $S_1$ and $S_3$ remain open (non-conductive). The modulated signal from transfer function circuit 14 is coupled to the non-inverting inputs (+) of amplifiers 18 and 20 via conductive switch $S_2$ and coupling capacitor 38. Additionally, a voltage divided version of the channel 1 audio signal is coupled to the inverting input (−) of amplifier 18 via the wiper of potentiometer 26, conductive switch $S_4$, coupling capacitor 54 and resistor 52. Therefore, amplifier 20 provides at its output, as a first synthesized stereophonic signal, the amplified modulated signal and amplifier 18 subtracts the channel 1 audio signal from the modulated signal and provides at its output, as a second synthesized stereophonic signal, the complement of the modulated signal.

In FIG. 2, response curves 200 and 300 respectively illustrate the amplitude versus frequency response of the signal paths (channels) associated with amplifiers 18 and 20 during the synthesis operating mode. The wiper of potentiometer 26 is adjusted during set-up of the synthesis mode to control the amplitude of the channel 1 audio signal coupled to the inverting input of amplifier 18, and thus control the depth of the notch at 700 Hertz in response curve 200.

It should be noted that the sum of the 200 and 300 frequency response curves comprise a full bandwidth and unattenuated audio frequency sound spectrum of the original monaural signal range. Thus, the full bandwidth of the original channel 1 signal is preserved in the two channels. However, the sound field created by these synthesized signals has an increased ambience due to the varying distribution of the audio frequencies between the channels. The amplitude of various audio frequency signals are reproduced in varying ratios in the two channels due to the amplitude modulation provided by transfer function circuit 14. This method of deriving synthetic stereo is particularly advantageous for use in conjunction with a television receiver kinescope display, including loudspeakers located on either side thereof. This is so because the equal amplitude points (corresponding to crossover frequencies of 320 Hz and 1,680 Hz) for the response curves occur within frequency ranges that respectively convey a significant portion of the intensity and articulation of the human voice. In this manner, human voices appear effectively centered on the kinescope display while providing an effective ambience for the remainder of the audio content. A more detailed discussion of the theory and operation of the synthesis mode of operation is found in the forementioned U.S. Pat. No. 4,239,939—Griffis, herein incorporated by reference.

It is noted that in the FIG. 1 arrangement, the plural operating modes are conveniently controlled by application of a DC voltage. Thus, for example, when the channel 1 and 2 outputs of source 10 correspond to the low level outputs from a stereo decoder, the detection of a pilot tone could be used to automatically switch to the true stereo mode. In this case, mode switch 32 can be constructed as an electrical equivalent of the mechanical version shown in FIG. 1.

FIG. 3 shows an embodiment of an audio signal processing portion of a television receiver which is designed for processing broadcast television signals including a monaural sound signal component, and which includes external stereo input terminals.

During the reception of a monaural broadcast, audio intermediate frequency (IF) signals from the output of the intermediate frequency video detector of the receiver are applied to an audio processing circuit 310, including a limiter amplifier 312, an FM detector 314 and a tone/volume signal processor 316. The audio IF signal is amplified and limited by amplifier/limiter 312 and a detected monophonic baseband audio information signal (50 Hz–15 KHz) is provided at the output of FM detector 314. The baseband audio signal is then applied to tone/volume processor 316 wherein the bass, treble and volume of the audio signal is adjusted. Audio processing circuit 310 can comprise an integrated circuit. One each integrated circuit, including an FM detector output terminal and tone/volume processor input terminal, is the TDA2791, manufactured by and available from Philips Corporation.

A tone/volume control 318 including user operated bass, treble and volume controls (e.g., potentiometers) provides respective bass ($B_1$), treble ($T_1$) and volume ($V_1$) control signals to tone/volume signal processor 316. Processor 316 adjusts the bass, treble and volume of the baseband audio signal from FM detector 314 in accordance with the control signals from control circuit 318, and applies the controlled monophonic audio signal to synthesizer 12 input terminal A via a buffer 320. Stereophonic synthesizer 12 is constructed and operates as described above with respect to FIG. 1 for providing either monophonic or synthesized stereophonic signals in response to the received monophonic signal.

The back panel of the television receiver includes channel 1 and channel 2 audio input terminals 322 and 324 for connection to an external source of baseband audio information signals, such as can be supplied by a video disc player or a video cassette recorder. The external channel 2 audio signal is applied to the input of tone/volume processor 328 via an isolation transformer 326. Processing circuit 328 can comprise the tone/volume processor portion only of a TDA2791 integrated circuit. In response to bass, treble and volume control signals ($B_2$, $T_2$ and $V_2$) from tone/volume control 318, processor 328 adjusts the bass, treble and volume of the external channel 2 audio signal and applies it to synthesizer input terminal B via a buffer 330.

When mode switch 32 of FIG. 1 is turned to the true stereo (TS) position, +12 volts is applied to control lines $C_5$ and $C_6$ of switch circuit 334 of FIG. 3, for closing switches $S_5$ and $S_6$. Switch 334, like switch 16 of FIG. 1, can comprise a CD4016B Quad Bilateral Switch integrated circuit, in which case only two of the four available switches would be used for switches $S_5$ $S_6$.

When switch $S_6$ is closed, the external channel 1 audio signal is applied to the input of the tone/volume processor 316 of audio processing circuit 310, via isolation transformer 332 and conductive switch $S_6$. When switch $S_5$ is closed, it connects a sound muting input (MUTE) of audio processing circuit 310 to ground, thus disabling limiter amplifier 312 and FM detector 314. The base, treble and volume of the channel 1 audio signal is adjusted by tone/volume processor 316 and applied to synthesizer input terminal A via buffer 320. Thereafter, synthesizer 12 separately amplifiers the external channel 1 and channel 2 audio signals as previously described with respect to the "true stereo" mode of operation.

It will be understood that variations of the illustrated preferred embodiments may be made by those skilled in the art without departing from the scope of the present invention. For example, a television receiver designed for receiving broadcast television signals including stereophonic sound components could provide the stereophonic left and right baseband audio signals directly to the inputs of tone/volume processors 316 and 328, respectively, of the FIG. 3 embodiment. Furthermore, the FIG. 3 embodiment could be modified to include a single-pole, double-throw switch for connecting either one of the external channel 1 or channel 2 audio signals to the input of switch $S_6$ of switch circuit 334. This arrangement would be particularly useful if the external source (e.g., a video disc player) supplied two different monophonic audio signals to inputs 322 and 324. For example, input channel 1 could provide the audio information monophonically in a first language and input channel 2 could provide the audio information monophonically in a second, different language. The single-pole, double-throw switch will allow the user to select which input channel of the audio information is applied to synthesizer 12. By means of mode switch 32 discussed in connection with FIG. 1, the user can select to have the audio information reproduced monophonically or as synthetic stereo. Finally, amplifiers 18 and 20 could serve as preamplifiers for subsequent higher power amplification stages.

What is claimed is:

1. In a system for processing audio information signals, apparatus comprising:

a source of at least one audio information signal;

transfer function means for producing a modulated signal in response to said audio signal;

first and second amplifier means, each including at least one input, and an output for providing amplified output signals;

switch means including plural inputs coupled independent of each other to said source of audio signal and said transfer function means, respectively, for selectively coupling said audio signal and said modulated signal to said amplifier means inputs, and which in a first position couples said audio signal and said modulated signal to said inputs of said first and second amplifier means for causing said first amplifier means to combine said input signals and thereby provide as said output signals of said first and second amplifier means first and second synthesized stereophonic signals, respectively; and which in a second position couples said audio signal to the input of at least one of said first and second amplifier means inputs for causing said one of said first and second amplifier means to amplify said audio signal and thereby provide as said respective output signal said audio signal.

2. Apparatus in accordance with claim 1 wherein:

said first and second amplifier means each include an inverting and a non-inverting input;

said switch means, in said first position, couples said audio signal to one of said inverting and said non-inverting inputs of said first amplifier means and said modulated signal to the other of said inverting and said non-inverting inputs of said first amplifier means, and said modulated signal to one of said inverting and said non-inverting inputs of said second amplifier means; and said switch means, in said second position, couples said audio signal to the same type of said inverting and non-inverting inputs of said first and second amplifier means.

3. Apparatus in accordance with claim 2 wherein:

said source provides first and second channel stereophonic signals; and said switch means, in said second position, couples said first and second channel stereophonic signals to the same type of input of said first and second amplifier means, respectively.

4. Apparatus in accordance with claim 2 wherein:

said sourse provides a monophonic signal as said audio signal; and said switch means, in a third position, couples said monophonic audio signal to the same type of input of said first and second amplifier means, respectively.

5. Apparatus in accordance with claim 1, 2, 3 or 4 wherein said first and second amplifier means each comprise an audio signal amplifier for providing a signal output at a power level sufficient to drive a sound reproducing loudspeaker.

6. In an audio signal translation system, an improved stereo synthesizer for a source of audio information signals, including a transfer function means for producing a modulated signal in response to an audio signal from said signal source and a matrix circuit including first and second amplifiers for matrixing said audio signal and said modulated signal to provide first and second synthesized stereophonic signals, wherein the improvement comprises:

switch means including plural inputs individually responsive to said audio signal and said modulated signal, for selectively coupling said signals to said matrix circuit, said switch means in a first position, causing said matrix to combine said modulated signal and said audio signal to form said synthesized stereophonic signals, and in a second position, causing said matrix to only amplify said audio signal.

7. Apparatus in accordance with claim 6 wherein:

said source of audio information signals selectively provides a monophonic signal as said audio signal or first and second channel stereophonic signals as said audio signal;

said switch means, in said first position, couples said monophonic signal and said modulated signal to said matrix circuit;

said switch means, in said second position, couples said first and second channel stereophonic signal to said matrix circuit; and said switch means in a third position, couples said monophonic audio signal to said matrix circuit.

8. In a television receiver including a display device, and an audio signal source selectively providing one of a single channel monophonic signal and a two-channel stereophonic signal, a stereophonic synthesizer comprising:

a first input terminal for receiving both said monophonic signal and one channel of said stereophonic signal;

a second input terminal for receiving the other channel of said stereophonic signal;

a transfer function circuit coupled to said first input terminal for providing at its output a modulated signal which varies in amplitude as a function of frequency in response to the signal provided at said first input terminal;

first amplifier means for providing an amplified signal to a sound reproducing loudspeaker located on one side of said display device;

second amplifier means for providing an amplified signal to a second sound reproducing loudspeaker located on the opposite side of said display device from said first loudspeaker;

first switch means for selectively completing a first signal coupling path, exclusive of said transfer function circuit, from said first input terminal to said first amplifier means;

second switch means for selectively completing a second signal coupling path, including said transfer function circuit, from said first input terminal to both said first and second amplifier means;

third switch means for selectively completing a third signal coupling path, from said second input terminal to said second amplifier means; and switch control means having a first state for causing said first and third switches to complete their respective coupling paths, and a second state for causing said first and second switches to complete their respective coupling paths.

9. Apparatus in accordance with claim 8 wherein:

said synthesizer further comprises fourth switch means for selectively completing a fourth signal coupling path, exclusive of said transfer function circuit, from said first input terminal to both of said first and said second amplifier means; and said switch control means includes a third state for causing only said fourth switch to complete its respective signal coupling path.

10. In a television receiver including a display device and an audio signal source selectively providing one of a single channel monophonic signal and a two-channel stereophonic signal, a stereophonic synthesizer comprising:

a first input terminal for receiving both said monophonic signal and one channel of said stereophonic signal;

a second input terminal for receiving the other channel of said stereophonic signal;

a transfer function circuit coupled to said first input terminal for providing at its output a modulated signal which varies in amplitude as a function of frequency in response to the signal provided at said first input terminal;

first amplifier means for providing an amplified signal to a sound reproducing loudspeaker located on one side of said display device;

second amplifier means for providing an amplified signal to a second sound reproducing loudspeaker located on the opposite side of said display device from said first loudspeaker;

first switch means for selectively completing a first signal coupling path, exclusive of said transfer function circuit, from said first input terminal to said first amplifier means;

second switch means for selectively completing a second signal coupling path, exclusive of said tranfer function circuit, from said first input terminal to both of said first and second amplifier means;

third switch means for selectively completing a third signal coupling path, inluding said transfer function circuit, from said first input terminal to both said first and second amplifier means;

fourth switch means for selectively completing a fourth signal coupling path, from said second input terminal to said second amplifier means; and switch control means having a first state for causing said first and fourth switches to complete their respective coupling paths, a second state for causing said first and third switches to complete their respective coupling paths, and a third state for causing only said second switch to complete its respective coupling path.

11. Apparatus in accordance with claim 10 wherein:

said first and second amplifier means each include an inverting and a non-inverting signal input terminal; and said first signal coupling path being coupled to one type of said inverting and non-inverting inputs of said first amplifier means, said second and third signal coupling paths being both coupled to the other type of said inverting and non-inverting inputs of said first and second amplifier means, and said fourth signal coupling path being coupled to said one type of said inverting and non-inverting inputs of said second amplifier means.

12. Apparatus in accordance with claim 11 wherein:

said first and fourth signal coupling paths each include an adjustable signal voltage divider.

13. Apparatus in accordance with claim 10 or 11 wherein:

said first and second amplifier means each comprise an audio signal amplifier for providing a signal output at a power level sufficient to drive said first and second loudspeakers, respectively.

* * * * *